US007461903B2

(12) United States Patent
Tewes et al.

(10) Patent No.: US 7,461,903 B2
(45) Date of Patent: Dec. 9, 2008

(54) CUTTING TOOL

(75) Inventors: Günter Tewes, Windhagen (DE); Bernd Holl, Neustadt (DE)

(73) Assignee: Wirtgen GmbH, Windhagen (DE)

( * ) Notice: Subject to any disclaimer, the term of this patent is extended or adjusted under 35 U.S.C. 154(b) by 343 days.

(21) Appl. No.: 10/540,805

(22) PCT Filed: Oct. 11, 2003

(86) PCT No.: PCT/EP03/11288

§ 371 (c)(1),
(2), (4) Date: Jun. 27, 2005

(87) PCT Pub. No.: WO2004/059128

PCT Pub. Date: Jul. 15, 2004

(65) Prior Publication Data

US 2006/0130342 A1 Jun. 22, 2006

(30) Foreign Application Priority Data

Dec. 27, 2002 (DE) ..... 102 61 646

(51) Int. Cl.
*E21C 35/19* (2006.01)

(52) U.S. Cl. ..... 299/102

(58) Field of Classification Search ..... 299/81.3, 299/102–104, 106–107, 110
See application file for complete search history.

(56) References Cited

U.S. PATENT DOCUMENTS

| | | | | |
|---|---|---|---|---|
| 4,456,306 | A * | 6/1984 | Wrulich et al. | 299/81.2 |
| 4,542,942 | A | 9/1985 | Zitz et al. | |
| 4,664,450 | A | 5/1987 | Radford | |
| 6,113,195 | A | 9/2000 | Mercier et al. | |

FOREIGN PATENT DOCUMENTS

| | | |
|---|---|---|
| DE | 77 20 281 | 11/1977 |
| DE | 28 39 292 | 3/1980 |
| DE | 33 00 168 A1 | 7/1984 |
| DE | 34 11 602 A1 | 10/1985 |
| DE | 92 11 739.2 | 12/1992 |
| DE | 43 22 401 C2 | 6/1996 |
| GB | 2055434 A * | 3/1981 |
| WO | 98/39553 | 9/1998 |
| WO | 99/45238 | 9/1999 |

* cited by examiner

*Primary Examiner*—Sunil Singh
(74) *Attorney, Agent, or Firm*—Pauley Petersen & Erickson

(57) ABSTRACT

A cutting tool of a cutting machine having a base part and a bit holder. According to this invention, the bit holder has a plug-in attachment, retained in a socket of the base part that has a stop against which the bit holder rests. To prevent the penetration of water and stone dust and to allow the bit holder to be easily detached from the base part, a sealing element is located between the bit holder and the base part, surrounding at least sections of the socket.

20 Claims, 3 Drawing Sheets

CUTTING TOOL

BACKGROUND OF THE INVENTION

1. Field of the Invention

This invention relates to a cutting tool of a cutting machine having a base element and a chisel holder, wherein the chisel holder has a plug-in shoulder which is retained in a plug-in receptacle of the base element, and wherein the plug-in receptacle is spatially connected with its surroundings via one or several openings.

2. Discussion of Related Art

A cutting tool is known from German Patent Reference DE 43 22 401 C2. The cutting tool contains a chisel holder and a base element which is fastened to a cylinder-shaped cutting body of a cutting machine. For fastening the chisel holder on the base element, the base element has a plug-in receptacle with a V-guide, into which a plug-in shoulder of the chisel holder can be pushed. The chisel holder is fixed in place using a pressure screw. Thus the exact positioning of the chisel holder has particular importance, also in case of repeated assembly/disassembly and exchange.

For absorbing the forces occurring during the operation, the base element has a stop, on which the chisel holder is supported. So that the effects of the stop are maintained and stress on the plug-in shoulder and the plug-in receptacle is prevented to the greatest extent possible, the chisel holder is arranged offset by an adjusting space in the area around the plug-in receptacle.

It is disadvantageous in connection with such cutting tools which are employed, for example, in road construction, that the pulverized rock and water penetrate the area of the plug-in shoulder and the plug-in receptacle. Pulverized rock and water can cause the plug-in shoulder, as well as the pressure screw, to become caught in the plug-in receptacle. Thus, the chisel holder can only be released from the base element with increased effort. Often the parts are damaged during forcible separation, which results in a more cost-intensive replacement. Also, the pulverized rock results in increased wear in this area, which leads to reduced service life and therefore to higher operating costs. While releasing the pressure screw, dirt which becomes caught on the pressure screw from the interior, is worked into the threaded receptacle of the base element and damages it. A repair or replacement of the base element which must occur then can only be performed with added outlay, because customarily the base element is welded to the cutting cylinder tube and the adjacent base elements.

Dirt on the plug-in shoulder of the chisel holder and in the area of the plug-in receptacle of the base element is particularly disadvantageous. The particles adhering there are shattered during subsequent operation of the machine. Play is then created between the plug-in shoulder and the plug-in receptacle. The exactly fitted positioning of the chisel holder is then no longer assured. This has a negative effect, in particular during so-called fine milling. This method, which is gaining importance in actual use, is used to mill road surfaces to their final quality in one processing step. A prerequisite for this is that the chisel holders are exactly positioned. If one chisel holder does not meet these criteria, it causes a wrong spot in the milling pattern, which has an effect on the total result. Thus, a chisel holder which is seated loosely in the base element can decisively worsen the milling quality. Also, the loosely seated chisel can become completely separated from the base element and seriously damage the tool.

SUMMARY OF THE INVENTION

It is one object of this invention to provide a cutting tool of the type mentioned above but wherein the service life of the tool, in particular of the base element, is improved.

This object is achieved if at least one of the openings is at least partially closed by a sealing element.

The sealing element protects the transition area of the plug-in receptacle formed between the plug-in shoulder and the base element. It prevents the penetration of the plug-in receptacle by removed material and water in a simple and effective way. Once the chisel holder reaches its worn state, it can be pulled out of the plug-in receptacle. The reception chamber formed by the plug-in receptacle remains clean and substantially free of dirt. It is possible to position and fasten a fresh chisel holder with little loss of time. Thus, the sealing element forms a simple component, which permits a more effective tool change, and at the same time substantially increases the service life of the base element. The sealing element can also be formed by a grease layer.

Depending on the shape and arrangement of the sealing element, a reproducible and exactly fitting position of the chisel holder is possible.

In accordance with a preferred embodiment of this invention, the sealing element is arranged around the plug-in receptacle, at least in some areas between the chisel holder and the base element. With this an area is protected through which often massive amounts of dirt can enter.

Particularly effective sealing is achieved if the sealing element is embodied as a molded element having the contour of the circumference of the plug-in shoulder of the chisel holder. The design is particularly installation-friendly, because the sealing element can be placed on the plug-in shoulder of the chisel holder for mounting and can then be installed in the base element together with the chisel holder.

Because the base element has a circumferential bezel around the plug-in receptacle, which is used as a seat for the sealing element, the sealing element is immovably seated during operations. Also, the bezel provides the space into which the sealing element is definitely pressed when mounting without a possibility of being destroyed. An optimal sealing effect is thus achieved.

Permanent sealing of the area to be protected is achieved if the sealing element is made of a permanently elastic material, preferably of silicon, or of a thermoplastic elastomer.

In one embodiment, the chisel holder rests with its stop against the stop of the base element, the base element has a shoulder extending at an angle relative to the stop, a clearance acting as an adjusting space is formed between the shoulder of the base element and the side of the chisel holder facing the shoulder, and the sealing element is shaped so that it bridges this clearance. With this arrangement, pulverized rock and water cannot penetrate the plug-in receptacle through the adjustment space.

A particularly easy assembly and assured sealing effects are achieved if the sealing element is angled in a manner corresponding to the angle between the shoulder and the stop of the base element.

Good sealing of the different gap widths in the area of the stop and the adjustment space can be achieved if the sealing element has a section of an O-shaped cross section, which rests at least in part against the stop of the base element and has a section which is angled off relative to the base element, which rests against the shoulder of the base element and has a thickened cross section which bridges the clearance, at least partially.

In one embodiment, the angled-off section has a wedge-shaped sealing lip, which is matched to the shape of the adjustment space. Unevenness and production tolerances of the chisel holder and the base element are thus compensated.

A cost-effective manufacture, even in large numbers, as well as narrow tolerance and a design matched to the production process, are made possible if the sealing element is embodied as an injection-molded element, and the sprue nose is arranged in an area of or near the cross section which is thickened corresponding to the clearance. With this arrangement, the sprue nose does not hamper the sealing effect of the sealing element.

A simple and exactly fitting mounting of the chisel holder on the base element is achieved if the sealing element is drawn as a separate plastic component on the plug-in shoulder, or if the sealing element is injection-molded on the plug-in shoulder as a plastic component.

In one embodiment of this invention, the chisel holder of the cutting tool has a plug-in shoulder formed on a base body and the plug-in shoulder has a sealing element extending around the plug-in shoulder in at least partial areas of its outer circumference. Thus it is possible to preform the chisel holder with the plug-in shoulder and the sealing element as a structural unit, to stock it as a unit and to install it quickly and cost-effectively as a replacement part.

BRIEF DESCRIPTION OF THE DRAWINGS

This invention is explained in greater detail in view of exemplary embodiments represented in the drawings, wherein.

DESCRIPTION OF PREFERRED EMBODIMENTS

Figure 1:
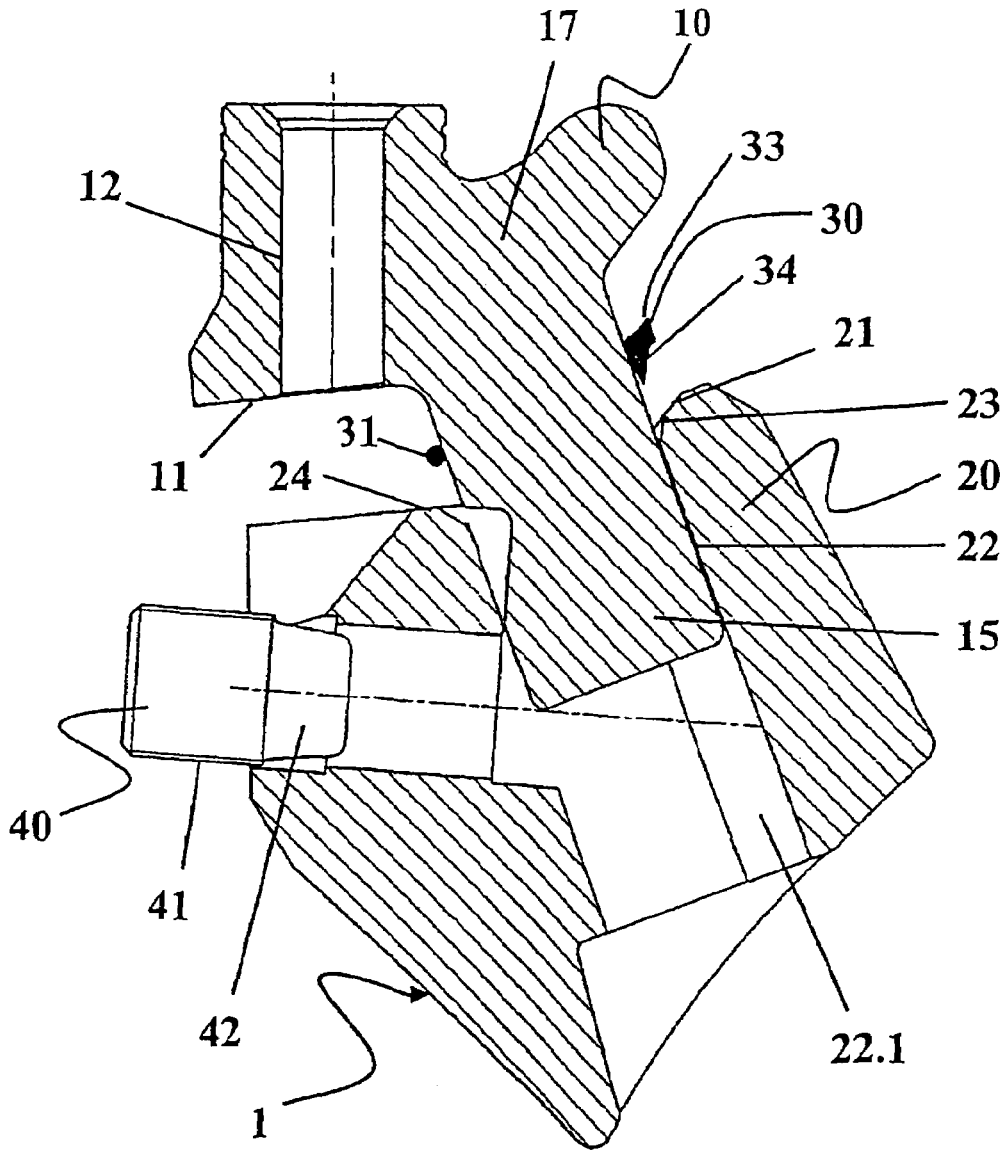
FIG. 1 is a lateral sectional view of a cutting tool with an exchangeable chisel holder in a partially assembled state.

The cutting tool (1) in FIG. 1 comprises a base element (20), into which an exchangeable chisel holder (10) can be inserted. The cutting tool (1) has a sealing element (30) and a pressure screw (40), which is used for fixing the chisel holder (10) in place in the base element (20).

The chisel holder (10) includes a base body (17) and on its lower end has a plug-in shoulder (15), which can be inserted into a corresponding plug-in receptacle (22) at the base element (20). The insertion movement of the chisel holder (10) into the base element (20) is limited in its rear area by a stop (11) at the chisel holder (10) and by a stop (24) on the base element (20) located opposite it. On its front edge, the plug-in shoulder (15) has at least one guide face (15.1), which is guided during insertion of the chisel holder (10) by a corresponding V-guide (22.1) in the plug-in receptacle (22).

Also, the chisel holder (10) has a chisel receptacle (12), into which a turning chisel, which is also easy to exchange, can be inserted. The longitudinal axis of the chisel receptacle (12) forms an acute angle with respect to the axis of the plug-in shoulder (15).

A sealing element (30) is drawn on the plug-in shoulder (15) which contour is matched to the prism-shaped cross-section of the plug-in receptacle (22) with its guide faces (15.1). The sealing element (30) can be angled, relative to the angle between the shoulder (21) and the stop (24) of the base element (20). Here, the sealing (30) has an O-shaped cross section (31) in the area of or near the stop (24) and a cross section, which is thickened in comparison with it, in the area of the shoulder (21). Here, this area is preferably formed as a wedge-shaped sealing lip (34).

In the area of or near the plug-in receptacle (22), the base element has a bezel (23) extending around the plug-in receptacle (22), which is used as a seating for the sealing element (30).

Figure 2:
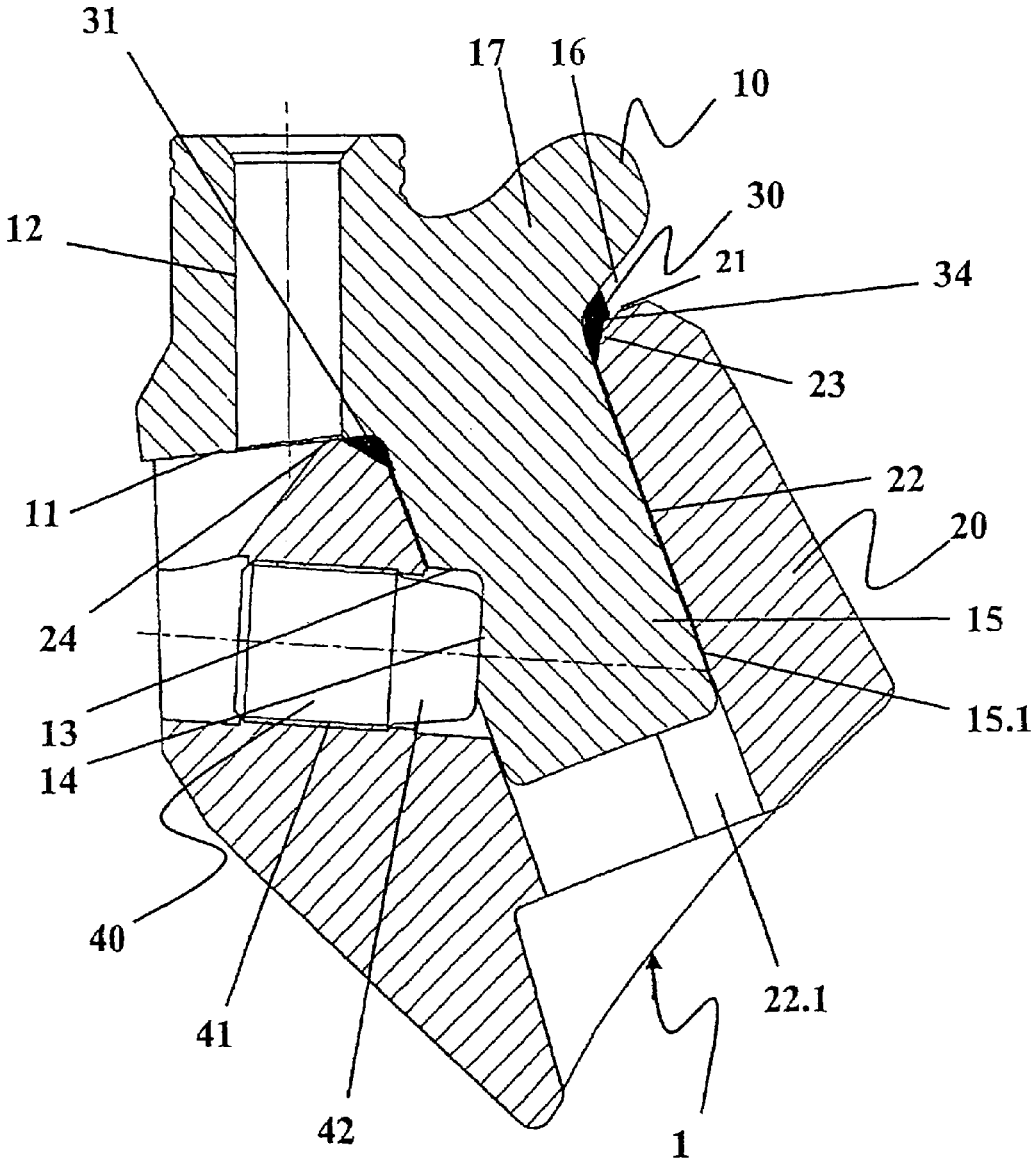
FIG. 2 is a lateral sectional view of the cutting tool in accordance with FIG. 1 but with the chisel holder inserted.

FIG. 2 shows the same cutting tool as shown in FIG. 1 in section with the chisel holder (10) completely inserted into the base element (20). Here, the pressure screw (40), which is preferably embodied as a stud screw and has a screw thread (41) and a flattened shaft (42), acts with its shaft (42) on a pressure face (14) formed by a V-shaped recess (13) on the side of the plug-in shoulder (15) located opposite the guide face (15.1).

When the pressure screw (40) is tightened, forces result which push the chisel holder (10) against the base element (20). During this, the stop (11) of the chisel holder (10) is supported on the stop (24) of the base element. During this, the sealing element (30) is seated with its area (31) of O-shaped cross section in the bezel (23) of the base element (20) designed as the sealing seat. The originally O-shaped cross section is pressed during this so that an optimum sealing effect is generated.

A clearance (16), acting as an adjustment space, is formed between the shoulder (21) in the front part of the base element (20) and the face of the chisel holder (10) located opposite the shoulder (21). With its cross section, which is thickened in this area, and the simultaneous embodiment as a wedge-shaped sealing lip (34), the sealing element (30) bridges the clearance (16), so that an optimal sealing effect is also thus achieved. With this arrangement, no waste material particles can penetrate into the area of the plug-in receptacle. This makes the exchange of the chisel holders (10) easier. At the same time, with this arrangement no water with waste material particles can penetrate the area of the shaft (42) and the pressure face (14) of the plug-in shoulder (15).

Figure 3A:
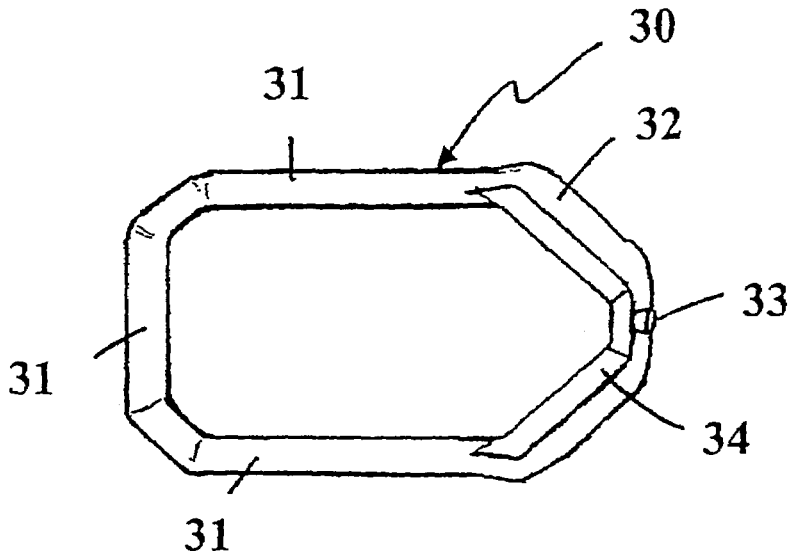
FIG. 3*a* is a sealing element in a top view.
Figure 3B:
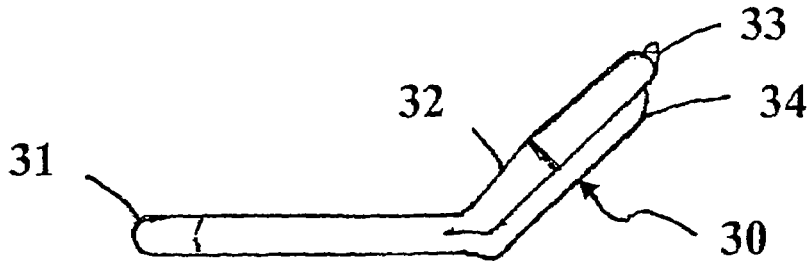
FIG. 3*b* shows the sealing element in accordance with FIG. 3*a*, in a lateral view.

FIGS. 3*a* and 3*b* represent an embodiment of the sealing element (30) in a top view and in a lateral view, respectively.

The sealing element (30) is embodied as a molded part, having the contour of the circumference of the plug-in shoulder (15) of the chisel holder (10). The sealing element (30) is angled corresponding to the angle between the shoulder (21) and the stop (24) of the base element (20), wherein the sealing element (30) has at least one section of an O-shaped cross section, which rests against the stop (24) of the base element (20). The angled section (32) resting against the shoulder (21) of the base element (20) has a cross section which is thickened corresponding to the clearance (16). An angled section (32) embodied as a wedge-shaped sealing lip (34) increases the sealing effect.

In this case, the sealing element (30) is made of a permanently elastic material and is preferably designed as an injection-molded element. Silicons are used as the materials. Examples of this are so-called liquid silicon rubbers (LSR), for example SILOPREN® made by GE BAYER Silicones, which can be produced by the so-called liquid injector molding (LIM) process. Also suitable are thermoplastic elastomers, for example SANTOPRENE®, made by ADVANCED ELASTOMER SYSTEMS, which can be worked by the normal injection-molding process. The sprue, which is customary in connection with injection-molding processes, is displaced into the thickened area of the clearance (16), so that the sprue nose (33) does not hamper the sealing effect of the sealing element (30).

The sealing element (30) can be directly formed on the formed-on plug-in shoulder (15) of the chisel holder (10), and thus enclosing the exterior circumference of the plug-in shoulder (15) at least partially. In the same way, the sealing element (30) can be directly formed on the base element (20)

in the area around or near the plug-in receptacle (22) and can enclose the exterior circumference of the plug-in receptacle (22), at least partially.

This invention is not limited to the cross-sectional shape of a plug-in shoulder (15) represented above and any arbitrary different cross-sectional variants are possible, such as round cross sections or plug-in shoulders of a conical shape, for example.

As shown in the drawings, the plug-in receptacle (22) in the base element (20) facing away from the chisel holder (10) is open. This opening is closed, together with the connected cutting cylinder tube, not represented in the drawings, by a weld seam connection.

The invention claimed is:

1. A cutting tool of a cutting machine having a base element and a chisel holder, wherein the base element has a plug-in receptacle spatially connected with its surroundings via an opening, and the chisel holder has a plug-in shoulder disposed through the opening and retained in the plug-in receptacle of the base element, the cutting tool comprising:

the chisel holder (10) having in a rear area a stop (11) resting against a second stop (24) of the base element (20), the second stop (24) disposed in a rear area of the base element (20), the base element (20) having a shoulder (21) extending at an angle relative to the second stop (24), the chisel holder (10) having a side facing the shoulder (21) of the base element (20), a clearance (16) extending forward of the second stop (24) and forming an adjusting space between the shoulder (21) in a front part of the base element (20) and the side of the chisel holder (10) facing the shoulder (21), and a sealing element (30) partially closing the opening, the sealing element (30) including a first portion that bridges the clearance (16) and has a cross section that is thickened in comparison with a second portion of the sealing element in an area of the stop (11) and the second stop (24).

2. The cutting tool in accordance with claim 1, wherein the sealing element (30) is arranged, at least in some areas between the chisel holder (10) and the base element (20), around the plug-in receptacle (22).

3. The cutting tool in accordance with claim 2, wherein the sealing element (30) is formed as a molded element having a contour of a circumference of the plug-in shoulder (15) of the chisel holder (10).

4. The cutting tool in accordance with claim 3, wherein the base element (20) has a circumferential bezel (23) extending at least partially around the plug-in receptacle (22), which is used as a seat for the sealing element (30).

5. The cutting tool in accordance with claim 4, wherein the sealing element (30) is made of a permanently elastic material, including one of a silicon and a thermoplastic elastomer.

6. The cutting tool in accordance with claim 5, wherein the sealing element (30) is angled corresponding to an angle between the shoulder (21) and the second stop (24) of the base element (20).

7. The cutting tool in accordance with claim 6, wherein the sealing element (30) has a section of an O-shaped cross section (31), which rests at least in part against an area of the base element (20) assigned to the second stop (24), and has a section (32) angled relative to the second stop (24) which rests against the shoulder (21) of the base element (20) and has a thickened cross section which at least partially bridges the clearance (16).

8. The cutting tool in accordance with claim 7, wherein the angled-off section (32) has a wedge-shaped sealing lip (34).

9. The cutting tool in accordance with claim 8, wherein the sealing element (30) is embodied as an injection-molded element, and a sprue nose (33) is arranged near the cross section which is thickened corresponding to the clearance (16).

10. The cutting tool in accordance with claim 9, wherein the sealing element (30) is one of a separate plastic component on the plug-in shoulder (15) or injection-molded on the plug-in shoulder (15) as a plastic component.

11. The cutting tool in accordance with claim 7, wherein the sealing element (30) is embodied as an injection-molded element, and a sprue nose (33) is arranged near the cross section which is thickened corresponding to the clearance (16).

12. The cutting tool in accordance with claim 1, wherein the sealing element (30) is formed as a molded element having a contour of a circumference of the plug-in shoulder (15) of the chisel holder (10).

13. The cutting tool in accordance with claim 1, wherein the base element (20) has a circumferential bezel (23) extending at least partially around the plug-in receptacle (22), which is used as a seat for the sealing element (30).

14. The cutting tool in accordance with claim 1, wherein the sealing element (30) is made of a permanently elastic material, including one of a silicon and a thermoplastic elastomer.

15. The cutting tool in accordance with claim 1, wherein the sealing element (30) is angled corresponding to an angle between the shoulder (21) and the second stop (24) of the base element (20).

16. The cutting tool in accordance with claim 1, wherein the sealing element (30) has a section of an O-shaped cross section (31), which rests at least in part against an area of the base element (20) assigned to the second stop (24), and has a section (32) angled relative to the second stop (24) which rests against the shoulder (21) of the base element (20) and has a thickened cross section which at least partially bridges the clearance (16).

17. The cutting tool in accordance with claim 16, wherein the angled-off section (32) has a wedge-shaped sealing lip (34).

18. The cutting tool m accordance with claim 1, wherein the sealing element (30) is one of a separate plastic component on the plug-in shoulder (15) or injection-molded on the plug-in shoulder (15) as a plastic component.

19. A cutting tool of a cutting machine, the cutting tool comprising:

a base element including a plug-in receptacle spatially connected with its surroundings via an opening, and a bezel extending around the opening of the plug-in receptacle;

a chisel holder, including a plug-in shoulder disposed through the opening and retained in the plug-in receptacle of the base element;

the chisel holder having a stop resting against a second stop of the base element;

the base element having a shoulder extending outward from the bezel at an angle relative to the second stop;

a clearance forming an adjusting space between the shoulder of the base element and a side of the chisel holder facing the shoulder; and a sealing element seated in the bezel and partially closing the opening, the sealing element including a first portion disposed between the stop (11) and the second stop (24) and a second portion extending out from the bezel into the clearance and having a shape that bridges the clearance, wherein the second portion is thicker than the first portion to bridge the clearance.

20. A cutting tool of a cutting machine having a base element and a chisel holder, wherein the base element has a plug-in receptacle spatially connected with its surroundings via an opening, and the chisel holder has a plug-in shoulder disposed through the opening and retained in the plug-in receptacle of the base element, the cutting tool comprising:

the chisel holder (10) having in a rear area a stop (11) resting against a second stop (24) of the base element (20), the second stop (24) disposed in a rear area of the base element (20), the base element (20) having a shoulder (21) extending at an angle relative to the second stop (24), the chisel holder (10) having a side facing the shoulder (21) of the base element (20), a clearance (16) extending forward of the second stop (24) and forming an adjusting space between the shoulder (21) m a front part of the base element (20) and the side of the chisel holder (10) facing the shoulder (21), and a sealing element (30) partially closing the opening, the sealing element (30) including a first portion that bridges the clearance (16) and has a cross section that is thickened in comparison with a second portion of the sealing element in the area of the stop (11) and the second stop (24);

wherein the base element (20) has a circumferential bezel (23) extending at least partially around the plug-in receptacle (22), the bezel is a seat for the sealing element (30), and the thickened first portion of the sealing element (30) extends out of the bezel into the clearance (16).

* * * * *